United States Patent [19]

Beierlein

[11] Patent Number: 4,658,128

[45] Date of Patent: Apr. 14, 1987

[54] ELECTRON VACUUM IMAGE INTENSIFIER WITH REFLECTION REDUCING OUTPUT SCREEN

[75] Inventor: Rainer Beierlein, Spardorf, Fed. Rep. of Germany

[73] Assignee: Siemens Aktiengesellschaft, Berlin and Munich, Fed. Rep. of Germany

[21] Appl. No.: 764,123

[22] Filed: Aug. 9, 1985

[30] Foreign Application Priority Data

Aug. 10, 1984 [DE] Fed. Rep. of Germany ..... 3429561

[51] Int. Cl.[4] ..... H01J 31/50

[52] U.S. Cl. ..... 250/213 VT; 313/525

[58] Field of Search ..... 250/213 R, 213 VT, 363 S, 250/483.1; 313/525–530, 485–487

[56] References Cited

U.S. PATENT DOCUMENTS

| | | | |
|---|---|---|---|
| 3,567,947 | 3/1971 | Robbins | 250/213 VT |
| 3,622,786 | 11/1971 | Walker et al. | 250/213 R |
| 4,096,381 | 6/1978 | Brown | 313/485 |

*Primary Examiner*—David C. Nelms

[57] ABSTRACT

An electron vacuum image intensifier for use in an x-ray diagnostic installation has an output screen followed by an objective lens system in the installation for connection to a picture receiving tube of a television chain. The carrier for the output luminescent screen of the intensifier is incorporated into the wall of the bulb or tube of the intensifier, and has a thickness corresponding to at least half of the diameter of the output image for avoiding reflections and improving the image quality.

12 Claims, 4 Drawing Figures

ELECTRON VACUUM IMAGE INTENSIFIER WITH REFLECTION REDUCING OUTPUT SCREEN

BACKGROUND OF THE INVENTION

1. Field of the Invention

The present invention relates to an electron vacuum image intensifier for use in an x-ray diagnostic installation, and in particular to improvements in the carrier plate structure for such an intensifier.

2. Description of the Prior Art

Various types of x-ray diagnostic installations are known in the art having different configurations, however a basic list of components for such systems generally includes a means for generating an x-ray beam, an x-ray image intensifier disposed after the subject through which the x-ray beam has passed for converting the image at an input screen into an electron image, a means for electronically and optically accelerating the image components onto an output luminescent screen, where the image is generated at the inside wall of the output window of a vacuum bulb in the intensifier. The intensifier includes a carrier having a thickness dimensioned such that total reflections occurring at the image exit surface of the intensifier output window at most return back to regions of the luminescent screen which are outisde of the observation region. Such an apparatus is described, for example, in U.S. Pat. No. 3,622,786.

In conventional x-ray diagnostic installations of this type having an image intensifier followed by an objective lens system, which is generally an objective system of a television chain, a problem exists in combining the separately constructed devices comprising the installation, that is, combining the image intensifier and the separate objective system. Distances between the surfaces through which the output image is transmitted remain in the optical transmission path, resulting in reflections at the optical boundary surfaces, in particular, at the carrier of the output luminescent screen of the image intensifier. Such images as well as the associated light scatter resulting therefrom deteriorate the image contrast, and additionally increase the background of the image thereby significantly reducing the image quality.

For avoiding the existance of boundary surfaces, optical fiber connections have been used in x-ray television chains, for example, as disclosed in U.S. Pat. No. 3,058,021. The fiber connections generally extend between the output of the image intensifier and the input of a following television camera. The use of such optical fibers, however, has the disadvantage that resolution losses also occur in addition to the light loss due to light absorption of the optical fibers. Moreover, division of the incoming light into a plurality of different receivers is not possible with the use of optical fibers. Attempts have been made to eliminate such unwanted background by improving the absorption and contrast of the transmissive material. For this purpose gray glass has been employed for use as the material comprising the luminescent screen carrier, or as an absorption layer, however the use of such glass has not been successful because such glass exhibits still a significant light loss and has the further advantage of being costly to manufacture.

Another effort to improve the output image of a picture tube is disclosed in European laid-open patent application No. 00 87 674 wherein the glass carrier of the output luminescent screen is made so much thicker that total reflections at the inside of its output surface do not proceed to the observation surface. In order to employ a luminescent screen of this type with a standard carrier, the output surface of the screen is bonded to the inside surface of the output window pane of the tube bulb to form a stack having a suitable thickness. In order to achieve adequate thickness, a transparent plate is additionally glued to the outside of the window pane under certain conditions. Therefore production of such a stack requires at least one glueing operation inside of the tube bulb. Acceptable adhesives are not currently available which are optically fault-free and vacuum-resistant, therefore picture tubes constructed in accordance with the aforementioned European application have not been commercially manufactured.

SUMMARY OF THE INVENTION

It is an object of the present invention to provide an x-ray image intensifier having an output screen composed of a stack of transparent plates which are glued to each other, and which are manufacturable with currently available means in a quality permitting practical use in an x-ray diagnostic installation.

The above object is inventively achieved in a carrier plate structure for an x-ray image intensifier wherein the carrier plate is employed as the output window in an opening of the wall of the vacuum tube of the image intensifier. The luminescent layer is applied directly to the carrier, simultaneously functioning as the output window pane of the intensifier bulb or tube, so that an adhesion surface which must be disposed in the high vacuum of the picture tube is avoided in comparison to conventional solutions to the problem. The thickness of the stack can then be obtained without difficulty by a corresponding plate of optical glass glued to the outside surface of the carrier simultaneously functioning as the output window. The adhesive employed need not be permanently vacuum-resistant, and the application of the plate, which must have optical quality, can be undertaken at a time in the assembly process after which the manufacture of the actual picture tube has been completed, so that neither the adhesive surface nor the optical glass plate need be exposed to the elevated heat required in the manufacture of the picture tube. The manufacture of the picture tube itself can be undertaken by any number of conventional processes.

Ordinary soft soda glass can be used for the carrier for the luminescent layer given a thickness of 0.5 through 10.0 mm, preferably 1 mm, whereas optical glass is employed for the thick plate. The large surfaces of the thick plate are optically precise so that no image errors arise, and an overall thickness in combination with the carrier and the adhesive layer of at least one half of the diameter of the image should be obtained, that is, the overall thickness should be on the order of 8 mm through 20 mm for standard x-ray image transducers. The above dimensions are calculated in order to avoid, dependent on the refractive index of the glass employed, that the outermost picture edge is not reflected back by total reflection at the glass-air surface boundary onto the luminophor within the image circuit.

The carrier for the output luminescent screen of the image intensifier may also be comprised of parallel planes of optical glass when a certain thickness is exceeded, however, manufacture of the carrier in this manner is expensive and for many applications cannot be suitably undertaken with the necessary precision. Moreover, optical glasses generally have too high an electrical conductivity for many applications.

A thick carrier is achieved in a simple and reliable manner by manufacturing the output luminescent screen in the conventional manner on a thin carrier, and employing the thin carrier as the output window of the image intensifier. After the image intensifier has been inspected, a correspondingly thick plate of optical glass is glued thereto. Thereby the expensive optical element need not be attached until all parts of the image intensifier have been tested for full functionability. Only materials which in combination yield the insulating requirements necessary for the output window are to be used for the carrier glass and as the optical glass.

A window having sufficient mechanical and electrical stability, as well as suitable optical quality, may also be obtained by the use of a thick pane of technical glass having the required electrical resistance inserted between the luminescent screen carrier and the pane of optical glass. This technical glass can be manufactured with suitable electrical resistance, which is not obtainable in many conventional optical glasses because of trade-offs necessary to achieve other important optical glass characteristics. The diameter of the intermediate pane of technical glass is preferably greater in diameter in comparison to the other panes within the stack. The laterally projecting surfaces of the intermediate pane are thus effective as a substantial insulating path between the luminescent screen carrier and the plate of optical glass.

The exterior surface of the plate of optical glass can be additionally improved by coating that surface with an anti-reflection layer, thereby lowering back reflections onto the luminophor layer. Although background light will still be contained in the output image because of a certain residual reflection which cannot be completely avoided, such background can be considerably reduced by the use of an absorption layer or the use of grey glass in one of the glass panes. In comparison to conventional arrangements, however, the strength of the absorption effect can be maintained at a low level because the majority of the background has already been eliminated by the use of the thick plate.

DESCRIPTION OF THE PREFERRED EMBODIMENTS

Figure 1:
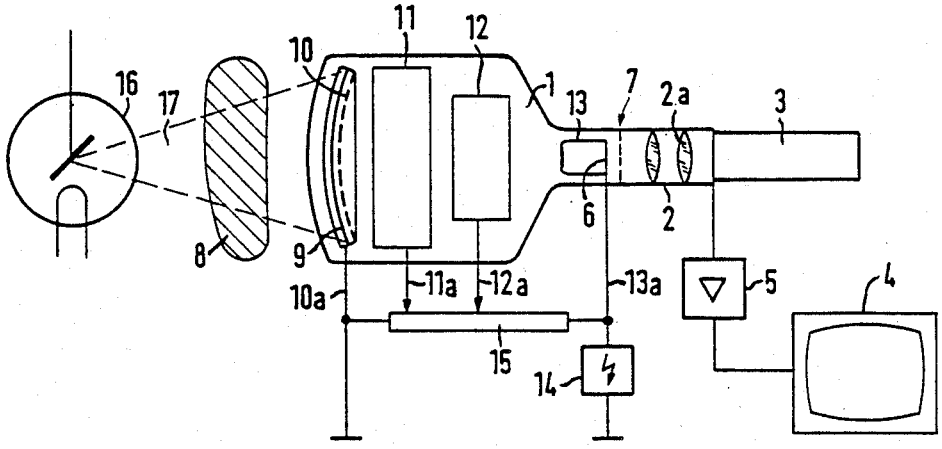
FIG. 1 is a schematic diagram of an x-ray diagnostics installation employing an x-ray image intensifier constructed in accordance with the principles of the present invention.

An x-ray diagnostic installation is shown in FIG. 1 of the type suitable for employment of an x-ray image intensifier constructed in accordance with the principles of the present invention. The installation includes an image intensifier 1 connected through an objective system consisting, for example, of lenses 2 and 2*a*, to a video pick-up tube 3. The image received by the tube 3 is reproduced on a video display unit 4 which receives signals from the tube 3 through an amplifier 5. The x-ray image of a subject 8 obtained on the output luminescent screen 6 of the image intensifier 1, and entering the objective system via the output window 7, is generated by means of the standard components of an image intensifier, that is, a luminescent screen 9, a photocathode 10, control electrodes 11, 12 and 13, and a high voltage source 14. Voltages are applied to the photocathode and to the electrodes 11, 12 and 13 via respective lines 10*a*, 11*a*, 12*a* and 13*a*. Suitable voltage division is undertaken by a potentiometer 15 connected to the lines.

The image arises by means of x-rays 17 emerging from an x-ray tube 16 which produce a luminous image on the screen 9 which in turn triggers electrons in the photocathode 10. The electrons then form an image on the output screen 6 by suitable operation of the electrodes 11, 12 and 13. An image is thus obtained through the objective system in the tube 3, which is then reproduced by the display unit 4.

Figure 2:
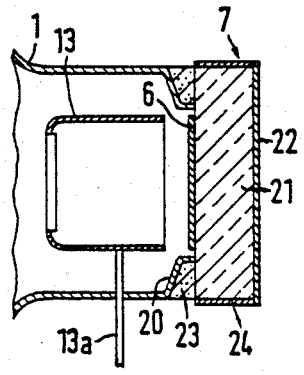
FIG. 2 is an enlarged cross sectional view of an x-ray image intensifier constructed in accordance with the principles of the present invention of the type suitable for use in the installation shown in FIG. 1.

In the exemplary embodiment of a portion of an image intensifier shown in FIG. 2, the window 7 connected to the output flange 20 of the image intensifier 1 is composed of a plate 21 of optical glass having a thickness of 16 mm and a diameter of 60 mm. At the side of the plate facing the interior of the image intensifier 1, the plate 21 carries the luminescent screen 6. The plate is coated with an anti-reflection layer 22 at its exterior surface. The layer 22 reduces back-reflections onto the luminophor. For connection to the image intensifier, the diameter of the plate 21 of optical glass is larger than that of the flange 20. An annular groove is thereby formed by the combination of the plate 21 and the flange 20, which is filled with casting compound 23. Greater creep distances thereby result for the high voltage insulation. An optically dense layer 24 is applied in an annular ring to the lateral sides of the plate 21. The layer 24 optimally absorbs light incident thereon which is not used for image generation, and consists of high voltage-resistant optical matte lacquer.

Figure 3:
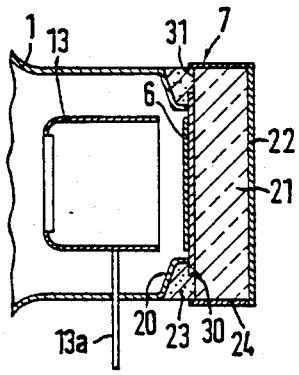
FIG. 3 is an enlarged sectional view of a further embodiment of an x-ray image intensifier constructed in accordance with the principles of the present invention.

In the embodiment shown in FIG. 3, the output window 7 has a carrier 30 for the luminescent carrier 6. The plate 21 of optical glass is attached to the carrier 30 by a layer 31 of optical adhesive, the plate 21 carrying the anti-reflection layer 22 at its exterior. Again, the plate 21 is provided at its lateral edges with a layer 24 of optically dense (black) lacquer.

Figure 4:
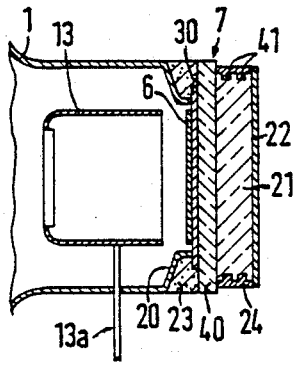
FIG. 4 is an enlarged sectional view of another embodiment of an x-ray image intensifier constructed in accordance with the principles of the present invention.

In the embodiment of FIG. 4, the optical window 7 has a member 21 of optical glass glued to the carrier 30 for the luminescent layer 6 with a plate 40 of technical glass disposed between the plate 30 and the member 21, the plate 40 projecting laterally beyond the stack by about 10 mm so as to form an annular ring extension. The plate 40 is approximately 3 mm thick. In order to increase the absorption capability of the side wall of the member 21, in addition to being provided with the optically dense layer 24, a plurality of annular recesses are introduced into the circumference of the plate 21, which are each approximately 2 cm wide and 2 cm deep. The recesses 21 function as diaphragms or light traps so that reflections are additionally prevented from emerging from the plate 21 and from back-reflecting onto the layer 6. The layer 22 is applied to the exterior of the plate 21 in order to further avoid back-reflections onto the luminophor layer.

The plate 21 may be curved, as shown in German AS No. 15 14 832 (FIG. 4). Although the curved luminophor carrier in that arrangement has the purpose of permitting a more simple electron optics, and thus a better sharpness distribution at the luminescent screen, the curved plate 21 in the present invention functions to prevent back and forth reflections and thus improve the image contrast.

The plate 21 can be additionally provided with a defined absorption so that improved contrast results due to the suppression of back and forth reflections (gray glass). The absorption is thereby limited to approximately 30% of the transmitted light, so that a significant amount of useful signal is not lost. The plate 21 may, for example, contain pigmentation for absorbing up to approximately 30% of the incoming light from the luminescent screen 6. In the embodiment employing the carrier 30, the carrier may contain pigmentation for the same purpose, or may include a layer absorbing up to 50% of the incoming light.

Although modifications and changes may be suggested by those skilled in the art it is the intention of the inventor to embody within the patent warranted hereon all changes and modifications as reasonably and properly come within the scope of his contribution to the art.

I claim as my invention:

1. An electronic image intensifier having an output window in an evacuated bulb, said output window comprising a light transmissive carrier connected to an opening in said bulb, said carrier having a luminescent screen on a side thereof facing said bulb and having an exterior image exit surface, and having a thickness therebetween such that light reflected from said exterior image exit surface returns only to portions of said luminescent screen outside of an observation surface of said screen.

2. An electronic image intensifier as claimed in claim 1 wherein said carrier has a layer structure comprising:

a first transparent glass pane inserted in said opening of said bulb, and having dimensions selected for providing sufficient mechanical strength for supporting said luminescent screen and for sealing said bulb; and a second transparent glass pane consisting of optical glass comprising the remaining thickness of said layer structure and being glued to an outside surface of said first transparent glass pane.

3. An electronic image intensifier as claimed in claim 2 further comprising a plate of electrically insulating soft soda glass glued between said first and second glass panes, said plate of soft soda glass having dimensions selected for electrically insulating said image intensifier.

4. An electronic image intensifier as claimed in claim 2 wherein said second transparent glass pane comprised of optical glass has a light absorbing coating thereon.

5. An electronic image intensifier as claimed in claim 4 wherein said light absorbing coating is applied around the edge of said second transparent glass pane in an annular ring.

6. An electronic image intensifier as claimed in claim 2 wherein said second transparent glass pane has at least one light trap at a periphery thereof.

7. An electronic image intensifier as claimed in claim 6 wherein said light trap is an annular recess in the periphery of said second transparent glass pane.

8. An electronic image intensifier as claimed in claim 1 wherein said carrier absorbs up to 50% of light transmitted from said luminescent screen.

9. An electronic image intensifier as claimed in claim 8 wherein said carrier has a light absorbing layer.

10. An electronic image intensifier as claimed in claim 9 wherein said carrier has pigmentation for absorbing said light from said luminescent screen.

11. In an electronic image intensifier for an x-ray diagnostic installation having an input screen for converting an image to be intensified into an electron image, means for accelerating electrons comprising said electron image onto an output luminescent screen, and having an output window, the improvement comprising said output window consisting of a carrier attached to an opening of said electron image intensifier having said luminescent screen on an interior side thereof and having an image output surface disposed a distance from said luminescent screen such that any light reflected from said image output surface toward an interior of said image intensifier is directed only at a portion of said luminescent screen outside of an observation surface of said screen.

12. An x-ray diagnostic installation comprising:

means for directing a beam of x-rays at an examination subject;

means for displaying an image of said subject obtained from said x-rays in a television chain; and an electronic vacuum image intensifier connected to said television chain through an output window for converting an image to be intensified at an input screen into an electron image with electrons comprising said electron image being accelerated onto an output luminescent screen, said output luminescent screen being carried on a carrier attached to said image intensifier and forming the output window therefore, said carrier having said luminescent screen mounted on an interior surface thereof and having an exterior image exit surface disposed a distance from said luminescent screen such that any back reflections from said exterior surface toward an interior of said image intensifier return only to portions of said luminescent screen outside of an observation surface of said screen.

* * * * *